United States Patent [19]

Lane

[11] 4,050,672

[45] Sept. 27, 1977

[54] TRAPEZOIDAL LIFTER

[76] Inventor: Perry Joe Lane, Rte. 1, Scobey, Miss. 38953

[21] Appl. No.: 765,698

[22] Filed: Feb. 4, 1977

[51] Int. Cl.[2] ..... B66F 7/26

[52] U.S. Cl. ..... 254/10 R; 214/390

[58] Field of Search ..... 254/2 R, 2 B, 2 C, 8 R, 254/8 B, 8 C, 9 R, 9 B, 9 C, 10 R, 10 B, 10 C, 45, 89 R; 214/390, 392, 515

[56] References Cited

U.S. PATENT DOCUMENTS

| | | | |
|---|---|---|---|
| 2,508,661 | 5/1950 | Campbell | 214/390 |
| 2,822,944 | 2/1958 | Blomgren | 214/390 |

FOREIGN PATENT DOCUMENTS

| | | | |
|---|---|---|---|
| 519,148 | 3/1955 | Italy | 214/390 |

*Primary Examiner*—Al Lawrence Smith
*Assistant Examiner*—Robert C. Watson
*Attorney, Agent, or Firm*—Wenderoth, Lind & Ponack

[57] ABSTRACT

A trapezoidal, open-ended lifting and moving cart having an upper and lower frame pivotably joined together. Upright support members are positioned on the upper frame and locking mechanism and a handle mechanism are connected to the lower frame. The handle mechanism is connected by chains to the upper frame for pulling the upper frame backward and upward, and the locking mechanism is spring-tensioned, actuated by a footpedal, and locks the handle mechanism in an upright position and the upper frame in the elevated position.

5 Claims, 4 Drawing Figures

TRAPEZOIDAL LIFTER

This invention relates to a lifting apparatus, and in particular relates to a lifting apparatus especially designed to lift and transport commercial sewing machines.

BACKGROUND OF THE INVENTION

There are known in the art various types of lifting devices which operate on the principle of a trapezoidal lifting mechanism. Such a mechanism usually incorporates a lower, essentially stationary platform, connected by parallel, spaced lifting arms to an upper, movable lifting platform. A pulling force exerted on the lifting platform causes the lifting platform to raise upward and be supported on the stationary platform by the lifting arms. In many instances, the stationary platform is provided with wheels attached thereto to facilitate moving the device from place to place.

Once the lifting platform has been raised, there are also various methods generally utilized for fixing or maintaining the lifting platform in this lifted position. Among the various techniques used are clamping devices connecting the lifting platform to other parts of the device and arrangements wherein the parallel lifting arms are locked in position by various locking arrangements.

SUMMARY OF THE INVENTION

In light of the current state of development of trapezoidal lifting devices, it is an objective of this invention to provide an improved lifting device of trapezoidal design in which the upper lifting platform is more easily and reliably secured in an upright position when an object is lifted thereby. This improved locking arrangement will promote safety and facilitate raising and lowering of the upper lifting platform.

It is further an object of the present invention to provide a trapezoidal lifting device with vertically adjustable, upright supports which are movable upward with the lifting platform. The supports may be adjusted initially to engage the object being lifted, such as a table or commercial sewing machine on the underneath side thereof, and lift the object when the lifting platform is raised. Once lifted, the item may be transported to a new location since the lifting device is also mounted on wheels.

The present invention is a trapezoidal, open-ended lifting and moving cart. Two independent frames, an upper and a lower frame, are connected together by a plurality of pivotable shackles on the sides thereof. Three upright, vertically and horizontally adjustable support members are welded to the upper frame. The support members are designed to be positioned underneath the object being moved and locked in that vertical position. Three caster wheels are mounted underneath the lower frame - two in front which are stationary, and one in the rear which may swivel. Also mounted on the rear of the lower frame, which is longer than the upper frame, are a locking mechanism and a handle mechanism. The handle mechanism is connected by two chains to the rear of the upper frame so that by pulling the handle backward, the upper frame is pulled backward and upward on the shackles and the object above the upright supports is lifted. The lock mechanism is designed to be actuated by a footpedal which, in turn, pivots rocker arms which release a latch that engages and holds the upper frame in the raised position and also releases the handle mechanism so that it can be pulled backward rather than remain in a locked upright position. The entire locking mechanism is maintained in a locking condition by a tensioned spring, and the spring tension is only overcome by depressing the footpedal.

BRIEF DESCRIPTION OF THE DRAWINGS

Further structure, objects and operation of the present invention will become apparent from the following description taken in conjunction with the drawings, wherein.

DETAILED DESCRIPTION OF THE INVENTION

Figure 1:
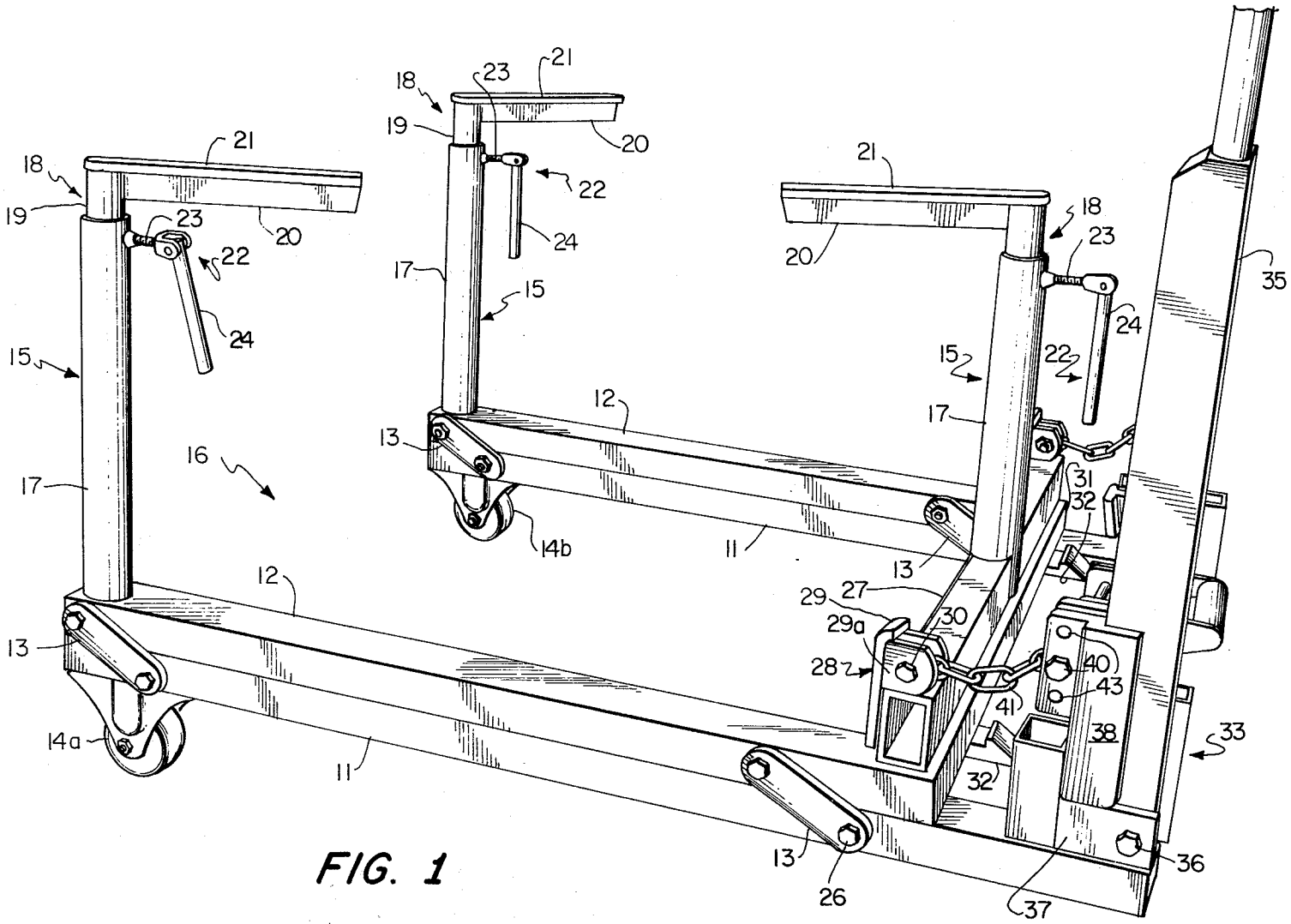
FIG. 1 is a perspective sideview of the cart of the present invention in a lowered position.
Figure 2:
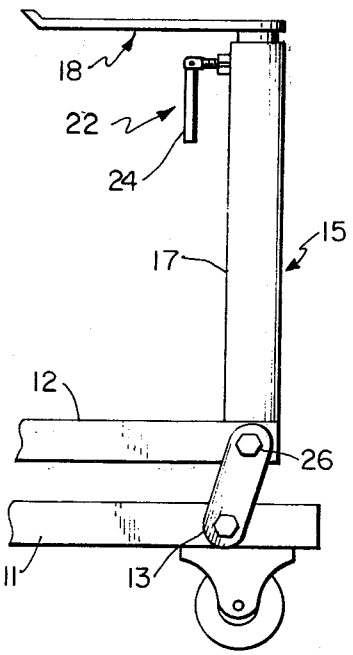
FIG. 2 is a sideview of the cart of the present invention in a raised position.
Figure 2:
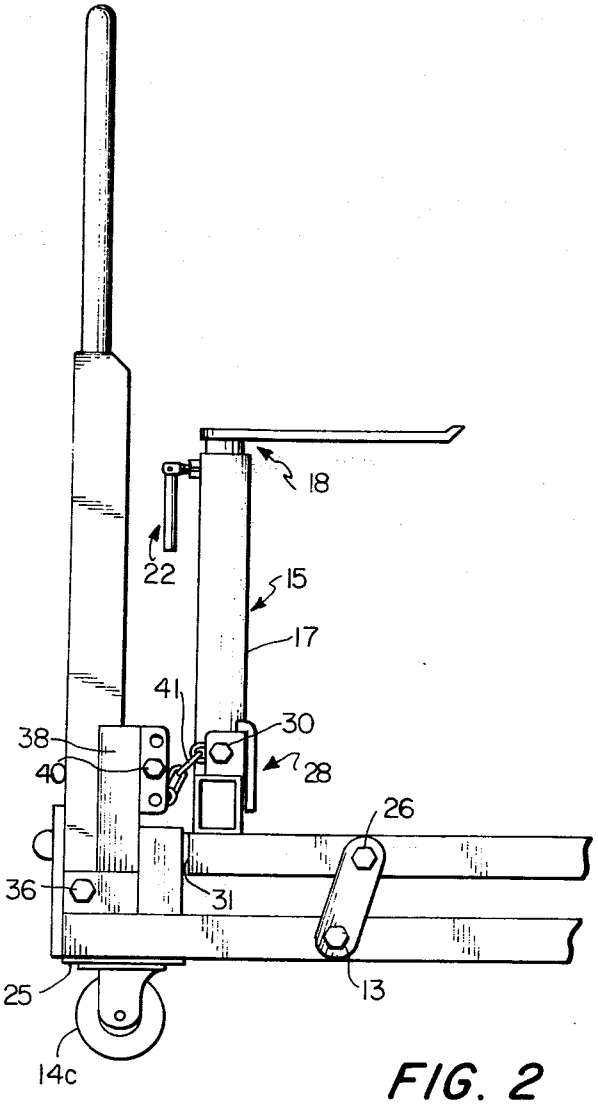

As shown primarily in FIGS. 1 and 2, the lifting cart of the present invention is essentially a combination of a lower cart frame 11 and an upper cart frame 12 connected to the lower frame 11 by a plurality of rotatable lifting shackles 13. Three caster wheels **14*a*, 14*b*, 14*c* are mounted by bolts or welded beneath the lower frame 11 in a triangular arrangement to facilitate pushing or pulling the cart from place to place, and three adjustable upright support members 15 are positioned in a corresponding triangular arrangement extending upward from the upper frame 12. These upright support members support from beneath an object (not shown), such as a table or sewing machine, which has a raised platform above the floor which may be abutted from beneath by the support members 15**.

The lower cart frame 11 and the upper cart frame 12 are constructed so that they are open at the forward portion 16 thereof. By having this open configuration, the cart, as a whole, is able to be positioned underneath the object to be lifted even though it is supported above the floor by leg-like supports. The open end 16 is especially useful when the supports are structured such that if a solid forward portion 16 were provided the cart would not be able to get under the object because the supports would be in the way.

The three adjustable upright support members 15 are securely connected to the upper frame 12 by any suitable means, such as welding. Each of the support members 15 is comprised of several distinct functional parts. At the top of and slidably fitted downward in each of three hollow supports 17 is an L-shaped swivel arm 18. One segment 19 of the swivel arm 18 is a rod vertically slidable and rotatable within the hollow support 17 and has affixed, as by welding, thereto at a right angle, an upper arm piece 20. The swivel arm 18 may rotate a full 360°. Each arm piece 20 is designed to fit under and contact the bottom surface of the object being lifted, and in the present embodiment each arm piece has a flat upper surface 21; even though any specially designed arm piece designed for specially fitting the particular object being lifted is considered to be within the scope of this invention. The extension and rotation of each L-shaped swivel arm 18 is controlled by a hand friction latch 22 which is rotatably mounted through the side of the hollow support 17 to force against and lock the lower segment 19 of the swivel arm 18 and prevent the swivel arm 18 from either rotating or moving vertically in the support member 17. The specific embodiment of the friction latch 22 in the present invention is a combination of a bolt 23 having a swivel handle 24 attached thereto threaded through the hollow support 17. To lock the movement of the swivel arm 18, the bolt 23 and handle 24 are rotated until the bolt 23 forces against the lower segment 19 of the swivel arm 18 and the swivel arm 18 can no longer move, either vertically or rotatably. The friction latch 22 may be positioned at any appropriate position along the support member 17, however, a position near the top thereof will allow greater vertical flexibility in positioning.

The forward two wheels **14*a*, 14*b* connected to the lower frame 11 are designed to be stationary with respect to the lower frame 11. The single rear wheel 14*c*, mounted on the rearward portion 25 of the lower frame 11** is, however, designed to swivel with respect to the frame so that turning and maneuvering the cart is facilitated.

The upper frame 12 is designed to be lifted away from the lower frame 11 in a pivotal manner by means of the parallel lifting shackles 13 rotatably secured by bolts 26 to the upper and lower frames 11, 12. When the upper frame 12 is pulled rearward, as will be discussed hereinafter, the shackles 13 are rotated and pulled backward and act as supports for holding the upper frame 12 away from the lower frame 11 in a trapezoidal configuration as shown in FIG. 2. The shackles 13 may be of any length and of any suitably strong material, such as steel or iron, that will insure that the object being lifted will be safely supported thereby when the upper frame 12 is lifted. The shackles 13, however, need only to be long enough to allow the object being lifted to merely clear the floor, thus enabling the cart to be rolled from place to place without the object dragging on the floor.

Figure 3:
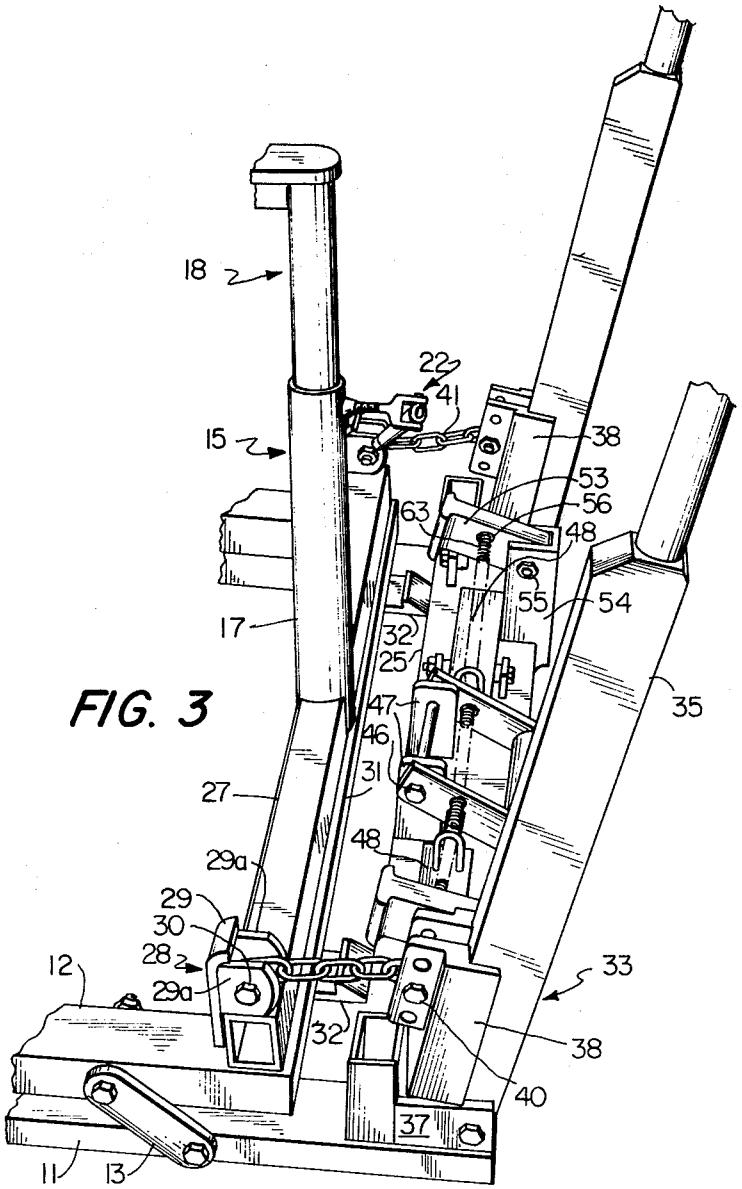
FIG. 3 is a perspective view of the handle and locking mechanisms of the present invention.
Figure 4:
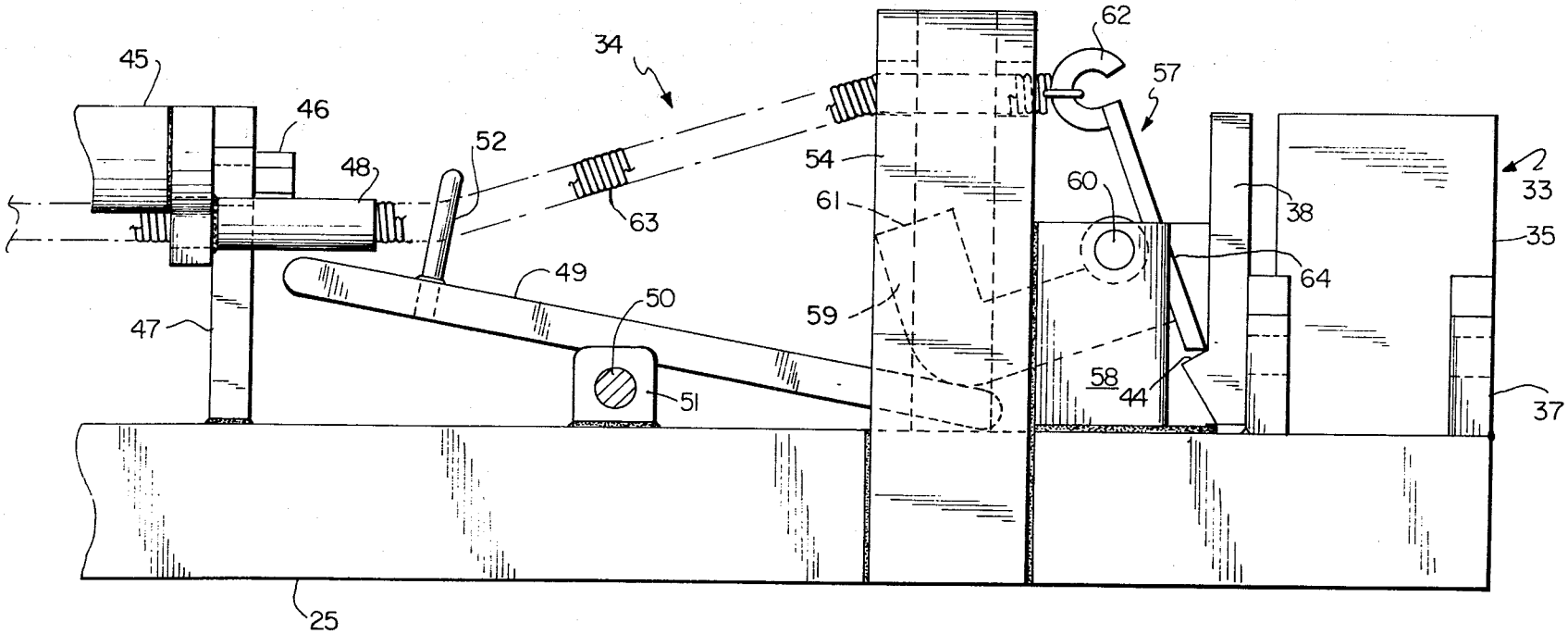
FIG. 4 is an end view of one half of the locking mechanism of the present invention.

As pointed out above, when an object is to be lifted, the upper frame 12 is simply pulled backward away from the lower frame 11, and the pivoting of the shackles 13 causes the upper frame 12 to lift away from the lower frame 11. FIGS. 3 and 4 most specifically disclose the structural features of the present invention used for pulling the upper frame 12 to thereby lift an object on the support member 15, and ultimately lock the upper frame 12 in the raised position.

On the rearward edge 31 of the upper frame 12 is a split reinforcing metal piece 27 welded or bolted to the frame 12 on both sides of the support member 15. Attached, by welding for example, to the forward surface of these reinforcing pieces, on both sides of the support member 15, are two chain holders 28,28 which are angled iron pieces 29,29 each having two side pieces **29*a*,29*a* welded thereto and to the top surface of the reinforcing piece 27. Fitted through holes in these side pieces 29*a*,29*a* is a bolt 30** with a nut attached thereto.

Underneath rearward edge 31 of the upper frame 12 are two angled latching members 32,32 welded or bolted thereto extending rearward from the frame. These angled members 32,32 have a sloped surface, at the end thereof farthest from the rearward edge 31 of frame 12 which drops off to a lower horizontal surface before the location where the angled latch members are attached to the frame 12.

Mounted on the rearward portion 25 of the lower frame 11 which extends behind the rearward portion 31 of upper frame 12 is a handle mechanism 33, which is used to pull the upper frame 12 backward and upward, and a locking mechanism 34, which locks the upper frame member 12 in the raised position and secures the handle mechanism 33 in an upright position.

A handle 35 is pivotably mounted by nuts and bolts 36,36 to a metal frame 37 welded to the rearward portion 25 of the lower frame 11. The handle 35 itself is essentially U-shaped and has two angled pieces 38,38 on both sides thereof affixed (as by welding) to the lower forward portion thereof opposite the chain holders 28,28 affixed to the reinforcing member 27 of the upper frame 12. Threaded bolts 40 are bolted through holes in these angled pieces 38 in a manner similar to the bolts 30 threaded through the holes of the chain holders 28,28. The bolts 30,30 of both the angled pieces 38 and the side pieces 37 are fitted through chains 41,41 which thereby connect the handle mechanism 33 to the upper frame 12. Thus, when the handle 35 is pulled backward, the chains 41 connected between the handle 35 and the upper frame 11 cause the upper frame 11 to lift.

The angled pieces 38 are formed with a plurality of holes 43 therein, so that the position of the bolt 40 through the chain 41 may be varied. In this way the angle at which the chain meets the angled pieces 38 can be determined in accordance with the weight of the object being lifted. Furthermore, as shown in FIG. 4, the inside angled pieces 38 on each side of the handle have a slanted surface 44 which extends downward away from the handle. These slanted surfaces serve to lock the handle 35 in the upright position in cooperation with the locking mechanism 34 in a manner as will be described shortly.

The locking mechanism 34 which is responsible for retaining the upper frame 11 in the raised position and the handle mechanism 35 in the upright position is best shown in FIGS. 3 and 4. FIG. 4 is a view of the right half of the locking mechanism 34, and since both halves of the mechanism are the same, the description will be with respect to this half only. Pivotably mounted in the center of the rearward portion 25 of the lower frame 11 is a footpedal 45. The pedal is attached by a nut and bolt combination 46 to two upright pieces of metal 47 welded to the lower framework 25. A projection 48 extends from each side of the pedal 45.

Adjacent the footpedal 45 is a rocker arm 49 which is mounted on the rearward portion 25 of the lower frame 11. The rocker arm 49 is designed to pivot back and forth in a see-saw fashion about a bolt 50 through two upright metal pieces 51 welded to the lower frame 25 and through the rocker arm 49. One end of the rocker arm 49 is positioned directly beneath the side projection 48 on the footpedal 45 and is contacted by the projection 48 when the pedal 45 is depressed. Also, the rocker arm 49 has a spring guide 52 attached thereto and extending thereabove. The spring guide 52 may be any guide with an opening therethrough through which a spring (as will be later described) can be fitted. In the present embodiment, the spring guide 52 is a U-shaped member welded or bolted to the rocker arm 49.

Adjacent the end of the rocker arm 49 opposite the end beneath the footpedal projection 48 is a locking latch 53 and a locking latch support 54. The locking latch 53 is an L-shaped member pivotably mounted at one end to the locking latch support 54, which is a 3-sided U-shaped metal framework welded to the rearward portion 25 of the lower frame 11. A bolt 55 passes through two aligned holes in the locking latch support 54 and through a hole in the locking latch 53 aligned in the latch support. The locking latch 53 is then pivotable up and down about the bolt 55. In addition, the forward portion of the locking latch 53, opposite the end bolted to the latch support 54, is positioned to engage one of the angled latch members 32 attached to the rearward edge 31 of the upper framework 12 when the upper framework 11 is pulled backward. When the locking latch 53 engages the angled latch member 32, the upper frame 12 is held locked in the raised position. The locking latch 53 also has a second hole 56 therethrough aligned with the spring guide 52 on the rocker arm 49 for allowing a spring to pass therethrough.

Directly adjacent the locking latch support 54 is a combination member serving as a locking latch lifter 59, tension spring holder 62 and handle release latch 64 pivotally bolted to a framework 58 welded to the rearward portion 25 of the lower frame 11. On the first side of this combination member 57, the portion serving as the locking latch lifter 59, is an L-shaped member extending from the pivot location 60 downward toward and resting at the angle of the "L" upon the end of the rocker arm 49 opposite the end thereof beneath the footpedal projection 48. The end 61 of the latch lifter 59 beyond the angle is positioned directly beneath the locking latch 53 pivotally mounted to the locking latch support 54. The upper portion of the second side of the combination member 57, the portion serving as the tension spring holder 62, is essentially a spring holder hook extending upward from the pivot location 60 and adapted to receive one end of a tension spring 63 which goes through the footpedal 45, the rocker arm spring guide 52 and the hole 56 in the locking latch 53. (The opposite end of the spring 63 is held by a similar tension spring hook on the opposite side of the footpedal 45.) The lower portion of the second side of the combination member 57 extends downward from the pivot location 60 and engages the slant surface 44 at the lower end of the handle mechanism 33, thereby serving as a handle latch 64.

The operation of unlocking and lifting the upper frame 12 and locking the raised upper frame in the raised position is, generally, as follows. The cart is rolled underneath the object to be lifted, and the three adjustable upright support members 15 are adjusted to fit against the bottom surface of the object being raised. Each swivel arm 18 of the support is securely held in position against the bottom of the object being moved by tightening the hand friction latch 22 against the lower segment 19 of the swivel arm 18 in the hollow support 17.

Once the swivel arms 18 are positioned and secured, the cart is ready to have the upper frame 12 lifted away from the lower frame 11, thereby raising the object off the floor so that it can be moved about. To lift the upper frame 12, the handle 35 must be pulled backward so that the chain 41 connecting the handle mechanism 33 and the upper frame 12 will pull the upper frame 11 as the handle mechanism 33 is pulled. The handle mechanism 33 is released by first depressing the footpedal 45 enough to force the rocker arm 49, under the projection 48 of the footpedal 45, downward. This downward motion at one end of the rocker arm 49 forces the other end upward against the combination member 57. When the locking latch lifter 59 is forced upward, the handle release latch 65 of the combination member 57 is pivoted downward about the pivot location 60 away from the slant surface 44 at the lower side of the angled piece 38 at the lower side of the handle 35. The handle mechanism 33 is then released and may be pulled backward by pulling on the handle 35.

As the handle 35 is pulled backward, the chain 41 tightens and pulls the upper frame 12 backward and upward on the shackles 13. During this rearward movement, the angled latching members 32 connected to the rearward edge 31 of the upper frame 12 and aligned with the locking latch member 53 are forced under the locking latch member 53 until the locking latch member 53, which is continuously forced downward because of the biasing force of the tension spring 63 therethrough, falls downward behind the angled slope of the latching members 32, and thereby locks the upper frame 12 in an elevated position on the shackles 13. Once the locking latch members 53 engage the angled latch members 32, the tension on the chain 41 may be released and the handle mechanism 33 returned to the upright position. Again, because of the continuous tension in the tension spring 63, the spring 63 pulls against the tension spring holder 62 on the combination member 57 and causes the handle release latch 64 to pivot about the pivot bolt 60 toward the handle mechanism 33 and the slant surface 44 at the bottom thereof to thus lock the handle mechanism 33 in the upright position.

The cart, once the upper frame 12 is lifted and secured and the object to be moved is lifted off the floor, can either be pushed or pulled to the desired location. Because the rear wheel 14c is on a swivel caster, the turning and maneuvering of the cart is easier.

When the object is finally moved to its destination, the handle mechanism 33 and locking latch members 53 are released, and the upper frame 12 lowered. By depressing the footpedal 45 all the way, the rocker arm 49 and combination member 57 are pivoted as before. The handle mechanism 33 is, however, released before the footpedal 45 is completely depressed. This allows the handle mechanism 33 to be pulled back and tension returned to the chain 41 before the locking latch members 53 are released, for when the pedal 45 is completely depressed, the rocker arm 49 pivots and causes the locking latch lifter 59 of the combination member 57 to pivot upward against the locking latch member 32 and forces the locking latch member 53 upward and away from the angled latch member 32, thereby releasing the upper frame 12. The upper frame 12 is then able to fall downward under its own weight and the weight of the object supported thereon. However, if the handle mechanism 33 has been pulled back to reintroduce tension into the chain 41, the upper frame 12 may be lowered slowly by slowly moving the handle mechanism 33 forward. When the handle mechanism 33 is again returned to the vertical position, the slant surface 44 at the lower portion thereof engages the handle release latch 64 after the footpedal 45 has been released and the combination member 57 is allowed to return to its normal position with the tension spring 63 pulling against the tension spring holder 62, thus causing the handle release latch 64 to pivot toward the slant surface 44. When the upper frame 12 is lowered and the swivel arms 18 are released from the locking force of the friction latch 22 and allowed to return to the down position, then the cart may simply be rolled out from under the object that was lifted and transported to the new location.

It can be appreciated from the above description that the tension spring 63 serves several useful purposes. When the footpedal 45 is not depressed, the tension of the spring 63 acts on the footpedal 45, through which it passes, to keep the footpedal 45 elevated and also, the spring 63 returns the footpedal 45 to the normal upright position when the pressure used to depress the pedal is removed therefrom. In addition, the force of the spring 63 acting on the spring guide 52 attached to the rocker arm 49 keeps that end of the rocker arm elevated and in contact with the side projection 48 of the footpedal 45. Finally, the tension of the spring 63 passing through the locking latch member 53 continuously forces the locking latch member 53 downward (thereby ensuring that the upper frame 12 remains elevated when the locking latch member 53 engages the angled latch members 32) and the tension of the spring 63 acting on the tension spring holder 62 of the combination member 57 pulls against the combination member 57 and causes the handle releasing latch 64 to continuously pivot toward and be forced against the slant surface 44 of the handle mechanism 33. The continuous force of the tension spring 63 maintaining all of the above-described conditions is only overcome by depressing the footpedal 45. The pedal 45 must, therefore, be pressed to cause the rocker arm 49 to pivot against the tension of the spring and cause the combination member 51 to pivot against the tension of the spring to release the handle mechanism 33, and further, the pivoting of the combination member 57 also forces the locking latch member 53 upward against the tension force of the spring to release the angled latch member 32 held thereby.

It will be apparent from the above-described embodiments that various modifications may be made to this invention, without going beyond the scope of this invention.

What is claimed is:

1. An apparatus for lifting and moving an object supported above a floor, said apparatus comprising:

a lower three-sided frame having an open forward end, two side portions, and a rear portion connecting said side portions;

an upper three-sided frame of smaller length than said lower frame above said lower frame, said upper frame having an open forward end corresponding to said open end of said lower frame, two side portions and a rear portion connecting said side portions;

shackle means pivotably connected between said upper frame and said lower frame for pivoting on said lower frame and lifting said upper frame from said lower frame and for supporting said upper frame above said lower frame;

wheel means beneath said lower frame for moving said connected frames from place to place;

upright support means connected to and extending upward from said upper frame and adjustable vertically and horizontally for supporting from beneath said object to be lifted and moved;

at least one chain connector attached above the rear portion of said upper frame;

a chain connected to each chain connected at one end thereof;

at least one angled latch member connected beneath and extending rearward from the rear portion of said upper frame;

handle mechanism means pivotably mounted on the rear portion of said lower frame and connected to the end of said chain opposite the end connected to said chain connector for pulling said chain and said upper frame backward and upward;

locking latch means connected to the rear portion of said lower frame opposite each angled latch member for engaging said angled latch member when said upper frame is pulled backward and for locking said upper frame in the raised position, said latch means having a first spring hole therethrough;

a rocker arm pivotably mounted onto the rear portion of said lower frame next to each locking latch means, one end of said rocker arm extending toward and underneath said locking latch means;

a spring guide mounted on the end of said rocker arm opposite the end extending toward said locking latch means;

foot pedal means mounted on the rear portion of said lower frame adjacent said rocker arm, a portion thereof extending over the end of said rocker arm having said spring guide for pressing against and depressing said rocker arm when said foot pedal is depressed, said foot pedal further having at least one spring hole therethrough;

a tension spring fitted through said spring hole in said foot pedal, said spring guide, and said spring hole in said locking latch means; and combination member means pivotably mounted on the rear portion of said lower frame between said locking latch means and said handle mechanism means for pivoting upward against and unlocking said locking latch means, for locking said handle mechanism means in an upright position and for holding the end of said spring and being tensioned thereby;

whereby partially depressing said foot pedal means depresses said rocker arm and causes said rocker arm to pivot upward against said combination member means and causes said combination-member means to rotate away from and release said handle mechanism means, whereby further depressing of said foot pedal means causes said rocker arm to pivot upward further against said combination member means and causes said combination member means to rotate against and lift said locking latch means, and whereby upon removing pressure from said foot pedal means, said tension spring through said foot pedal means causes said foot pedal means to return to its upright position, causes said locking latch means to be pulled downward, and causes said combination member means to rotate toward said handle mechanism means and away from the position of lifting said locking latch means.

2. An apparatus as claimed in claim 1 wherein:

said wheel means is comprised of three caster wheels mounted beneath said lower frame, two stationary wheels, one on each side of said forward open end, and one swivel mounted wheel at the midpoint of said rear portion connecting said side points; and said shackle means is comprised of four parallel metal shackles, two shackles connected between corresponding side portions of said lower frame and said upper frame in a parallel spaced relationship.

3. An apparatus as claimed in claim 1 wherein said upright support means is comprised of:

three hollow upright supports mounted on said upper frame, one on each side portion of said frame at the forward open end thereof, and one at the midpoint of said rear portion thereof;

three L-shaped swivel arms each arm vertically slidable and horizontally rotatable within one of said hollow upright supports; and locking means on each upright support for holding said swivel arm in the desired vertical position and for preventing rotation of said swivel arm.

4. An apparatus as claimed in claim 3 wherein each locking means is comprised of:

a bolt threaded through said hollow upright support toward said swivel arm therein; and a swivel handle attached to said bolt for rotating said bolt against said swivel arm, whereby said swivel arm is locking into position vertically and prevented from rotating horizontally.

5. An apparatus as claimed in claim 1 wherein:

said handle mechanism means is comprised of:

an inverted U-shaped handle pivotably connected at both lower ends thereof to the rear portion of said lower frame, two angled pieces at the sides of both ends of said handle, the forward portions of said angled pieces at the front of said handle being spaced from each other and having at least one pair of aligned spaced holes therethrough, and each angled piece on the insides of said handle having a sloping portion extending away from said handle beneath said combination member means, and bolt means through said holes in said angled pieces for connecting said chain to said angled pieces;

said locking latch means is comprised of:

a locking latch support affixed to the rear portion of said lower frame opposite each angled latch member extending rearward from said upper frame, and an angled locking latch pivotably mounted in said locking latch support, extending forward therefrom toward said angled latch member, and engageable with said angled latch member when said upper frame is pulled back, whereby engaging said locking latch with said angled latch member holds said upper frame in the raised position, said locking latch having a spring hole therethrough for allowing said tension spring to pass therethrough; and said combination member means is comprised of:

a support framework attached to the rear portion of said lower frame between said locking latch support and said handle, a combination member pivotably mounted in said support framework, said combination member having:

an L-shaped locking latch lifter extending from said pivot location downward against the end of said rocker arm and then upward against said locking latch, a handle release latch extending from said pivot location, on the side opposite said locking latch lifter, downward against the sloping portion of the inside angled piece connected to said handle, and a hooked tension spring holder extending upward from said pivot location and engaging the end of said tension spring;

whereby slightly depressing said foot pedal means causes said rocker arm beneath said L-shaped locking latch lifter to raise against said lifter and rotate said handle release latch away from said sloped angled piece, thereby releasing said handle, whereby further depressing said foot pedal means causes said rocker arm to lift said locking latch to contact and lift said locking latch held by said locking latch support, and whereby releasing said foot pedal allows said tension spring to pull against said tension spring holder and thereby rotate said handle release latch back toward said sloping portion and rotate said locking latch lifter downward away from said locking latch.

* * * * *